United States Patent [19]

Reesing

[11] Patent Number: 4,984,631

[45] Date of Patent: Jan. 15, 1991

[54] SYSTEM AND PLUG FOR PLUGGING A CONDUIT

[75] Inventor: David L. Reesing, Irving, Tex.

[73] Assignee: Otis Engineering Corporation, Dallas, Tex.

[21] Appl. No.: 367,931

[22] Filed: Jun. 19, 1989

[51] Int. Cl.[5] ..... E21B 23/02; E21B 34/14

[52] U.S. Cl. ..... 166/115; 166/123; 166/126; 166/181; 166/192; 166/237; 166/332

[58] Field of Search ..... 166/373, 281, 125, 123, 166/126, 128, 141, 150, 152, 179, 181, 185, 188, 192, 194, 203, 324, 332, 136, 214, 133, 217, 285, 334, 113, 184, 237, 238, 115

[56] References Cited

U.S. PATENT DOCUMENTS

| | | | |
|---|---|---|---|
| 2,806,539 | 9/1957 | Green et al. | 166/188 |
| 3,208,531 | 9/1965 | Tamplen | 166/125 |
| 4,373,583 | 2/1983 | Waters | 166/113 |
| 4,437,522 | 3/1984 | Krause, Jr. et al. | 166/382 |
| 4,479,539 | 10/1984 | Tamplen et al. | 166/237 X |
| 4,522,259 | 6/1985 | Akkerman | 166/237 |
| 4,545,434 | 10/1985 | Higgins | 166/217 |

OTHER PUBLICATIONS

Otis Engineering Catalog OEC-5338 Cover, p. 126 (Subsurface Flow Control Completion Equipment), Back Cover-(No Date Shown).

*Primary Examiner*—Hoang C. Dang
*Attorney, Agent, or Firm*—Roland O. Cox

[57] ABSTRACT

A system and a plug for plugging a well conduit. The plug includes a lock mandrel and a valve. There is a prong releasably connected in the plug. A running tool is adapted to releasably connect to the plug lock mandrel and prong. After the plug is lowered into a well conduit and installed in a landing nipple, upward releasing force on the running tool moves the prong upwardly closing the valve and plug to flow and the prong locks in valve closed position. Later, the prong may be disconnected and raised from the plug to surface, permitting pressure outside and inside the plug to equalize for retrival of the plug.

15 Claims, 5 Drawing Sheets

SYSTEM AND PLUG FOR PLUGGING A CONDUIT

BACKGROUND OF THE INVENTION

1. Field of the Invention

This invention relates to flow controls used in well conduits. The invention specifically relates to a plug having a prong which is attached to a running tool and lowered into a well conduit to be operated to seal and lock in a landing nipple in the well conduit.

2. Description of Related Art

Flow conduits in producing wells are usually equipped with landing nipples to receive various flow controls required during the operating life of the well. While performing remedial well services in a well, it is sometimes necessary to install a plug in a landing nipple to prevent flow in either direction in the conduit. Examples of various forms of plugs or plug chokes are shown on page 126 of the "Otis General Sales Catalog" OEC 5338, a publication of Otis Engineering Corporation, P.O. Box 819052, Dallas, Tex. 75381-9052. Illustration MS 485 on page 126 shows a form of plug having a prong installed therein. Installation of this plug, in a landing nipple in a well conduit, requires a running tool to be attached to the plug lock mandrel. The running tool and lock mandrel are lowered on wireline or pumped down the well conduit and the lock mandrel is operated to seal and lock in the landing nipple and the running tool is manipulated to release from the lock mandrel and be raised or pumped back to surface. Next, the prong is connected to another runnign tool on the surface. The prong running tool and prong are then lowered into the well conduit and down into the plug locked in the landing nipple. The prong seals inside the plug closing the plug to flow and the prong running tool is manipulated to release the prong and is raised back to surface. When it is desirable to remove this plug from the landing nipple, a prong pulling tool must be lowered into the conduit to latch into the prong and raise the prong out of the plug and back to surface.

SUMMARY OF THE INVENTION

This invention provides a plug having a lock mandrel with seals and a prong releasably attached in the plug. Both the plug and lock mandrel with prong are releasably attached to a running tool to be lowered into a well conduit having a landing nipple. Both plug and prong are installed in the landing nipple at the same time saving another run to install a prong in the plug. The plug has a valve body with flow ports connected below the lock mandrel seals. Seals on the prong are positioned below the ports, while the plug is being lowered into the conduit, to permit displaced fluid to flow through the ports up through the prong and out the top of the running tool.

After the lock mandrel has been operated to seal and lock the plug in the landing nipple, the running tool is released from the plug and prong by applying an upward force to the running tool sufficient to shear a first pin connecting the running tool to the plug lock mandrel. Continued upward movement of the running tool moves seals on the prong to above and below the valve body ports, closing the ports and plug to flow and shears a second pin releasing the running tool from the prong. The closed plug prevents flow in either direction through the landing nipple and conduit.

An object of this invention is to provide a plug having a prong connected therein and a running tool which installs the plug and prong together in a landing nipple.

Another object of this invention is to provide a plug with a prong connected therein which when connected to the running tool forms an internal flow passage for fluids displaced while lowering the plug and running tool into a well conduit.

Another object of this invention is to provide a plug with a connected prong therein which when connected to the running tool forms a flow passage for displaced fluids and after the plug is installed in a landing nipple, the flow passage is closed to flow and locked closed, closing the plug and landing nipple to flow when the running tool is released from the plug.

Yet another object of this invention is to provide a plug from which the prong may be disconnected and retrieved after the plug is closed to flow, permitting pressure outside and inside the plug to equalize.

DESCRIPTION OF THE PREFERRED EMBODIMENT

Figure 1B:
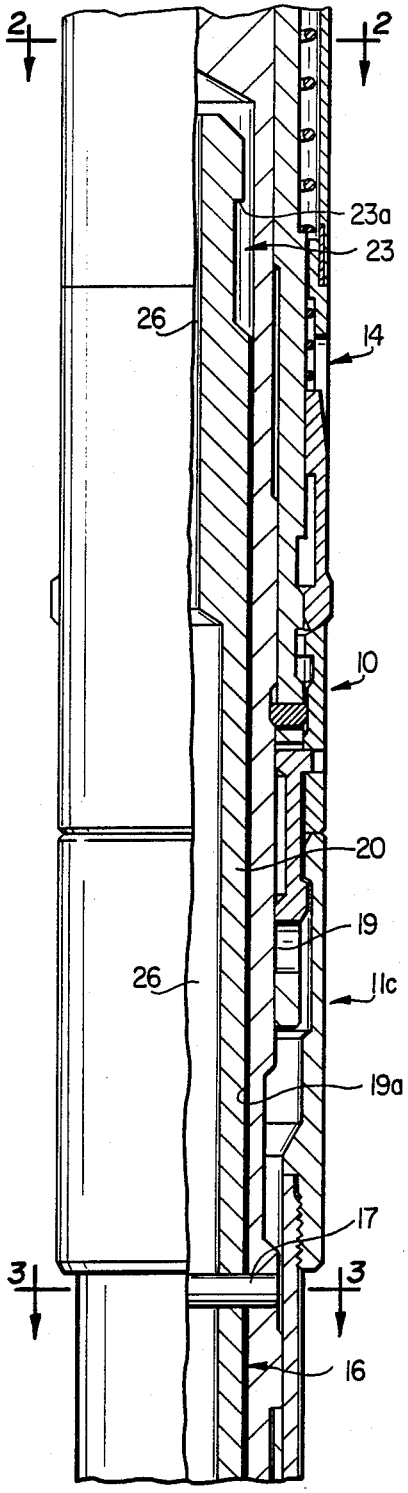
FIGS. 1A, 1B, 1C and 1D is a half sectioned drawing in elevation showing the plug of this invention, with the prong releasably connected in the plug and both plug and prong connected to a running tool, ready to be lowered for installation in a landing nipple in a well conduit.
Figure 1A:
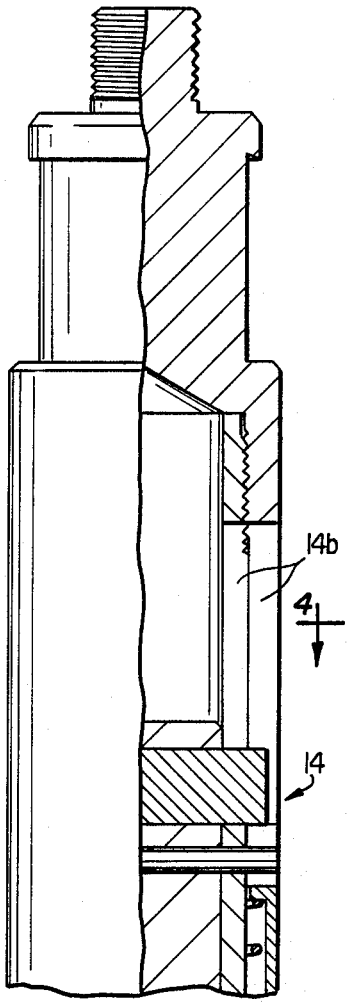
Figure 1C:
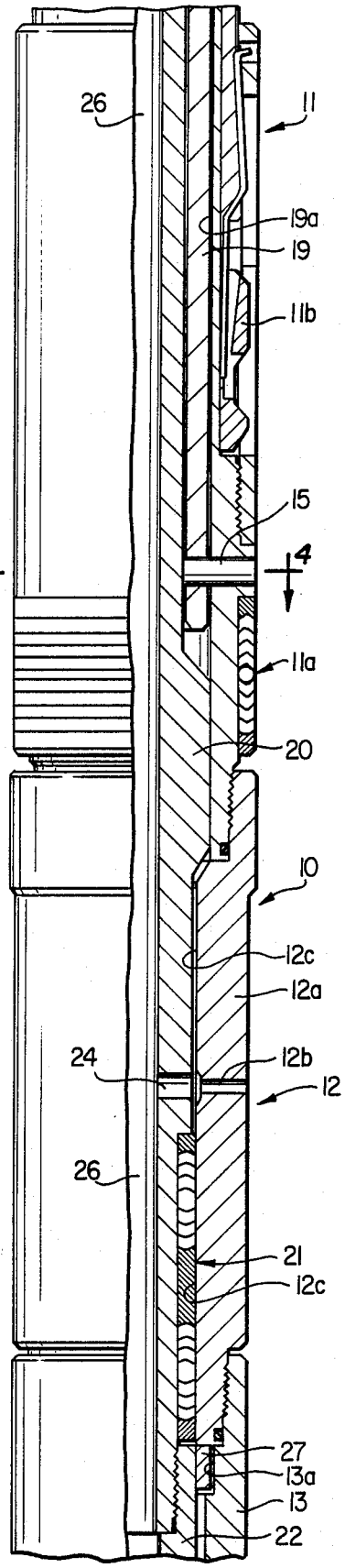
Figure 1D:
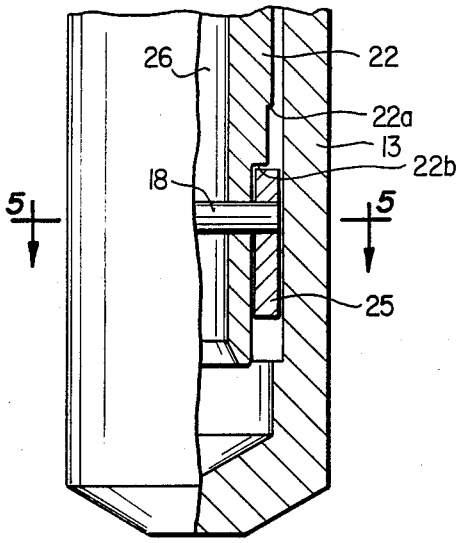
Figure 3:
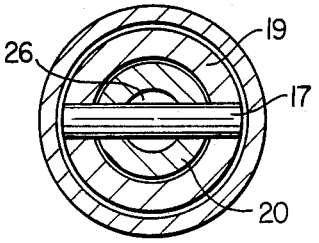
FIG. 3 is a cross sectional drawing along line 3—3 of FIG. 1.
Figure 4:
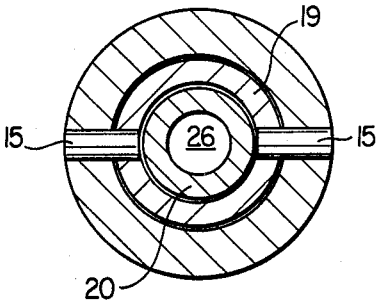
FIG. 4 is a cross sectional drawing along line 4—4 of FIG. 1.
Figure 5:
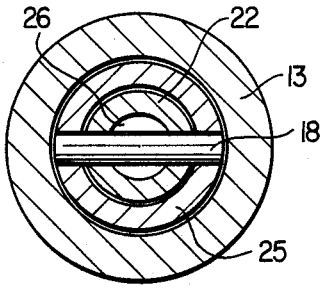
FIG. 5 is a cross sectional drawing along line 5—5 of FIG. 1.

FIGS. 1A, 1B, 1C and 1D show the invention plug 10 which includes a locking mandrel 11 with seals **11*a*, keys 11*b*, a valve 12 and a cap 13 having a bore 13*a*. The valve housing 12*a* is connected and sealed to the lower end of the lock mandrel and the cap is connected and sealed to the lower end of the valve housing. A running tool 14 engages lock mandrel fishing neck 11*c* and is connected to the plug with first (weaker) shearable pins 15 (see also FIG. 4) and to a prong 16 with second (stronger) shearable pin 17 (see also FIG. 3). The prong is slidably mounted for longitudinal movement in the plug and is releasably retained in the plug by a third (strongest) shearable pin 18 (see also FIG. 5**).

The running tool 14 and lock mandrel 11 shown are substantially the same as the inserting tool and locking device of U.S. Pat. No. 3,208,531 to J. W. Tamplen, herein incorporated for reference. Only the core of the referenced inserting tool has been modified to receive the prong 16 of the present invention and prong 16 is releasably connected to the core with pin 147.

The plug with prong of this invention could be utilized with any lock mandrel and running tool which can be installed to seal and lock in a landing nipple in a well conduit.

Prong 16 is mounted for longitudinal movement and releasably connected in bore 19*a* in running tool core 19 by shearable pin 17. The prong includes an upper section 20 on which carried seals 21 and to which is connected a retainer 22. The upper section is provided with a fishing neck 23, having a pulling flange 23*a*, holes for receiving pin 17 and a number of flow ports 24. The retainer retains seals 21 on the upper section and has an upper shoulder 23*a* and a lower shoulder 22*b*. Releasably positioned around the lower of the retainer by pin 18 (see FIG. 5) is a ring 25. A flow passage 26 extends longitudinally through prong 16.

A c-ring (cut ring) 27 is expanded by the larger outside diameter of the retainer above shoulder 22*a* into a groove formed by bore 13*a* in the cap and the lower end of valve housing 12*a*, which has flow ports 12*b* and a seal bore 12*c*, which is sealingly engaged by seals 21.

Figure 2:
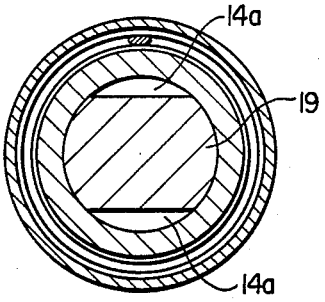
FIG. 2 is a cross sectional drawing along line 2—2 of FIG. 1.
Figure 6:
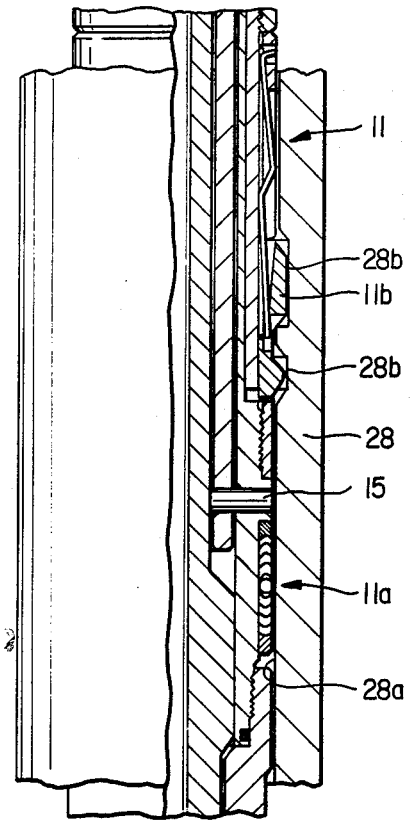
FIG. 6 is a fragmentary view of FIG. 1 showing the plug installed in a landing nipple.

To install the plug of this invention in a landing nipple in a well conduit, the plug is first connected to an appropriate running tool and lowered into the well conduit. While the plug is being lowered in the conduit, valve 12 is open and displaced liquid may flow through ports 12*b* and 24 into passage 26, out the top of prong upper section 20, through running tool openings 14*a* (see FIG. 2) and slots 14*b* in the running tool. As the plung lock mandrel 11 enters landing nipple 28, mandrel seals 11*a* sealingly engage landing nipple seal bore 28*a* and the lock mandrel has been operated so that keys 11*b* locate and are locked in the landing nipple recesses 28*b* as shown in FIG. 6.

Figure 7:
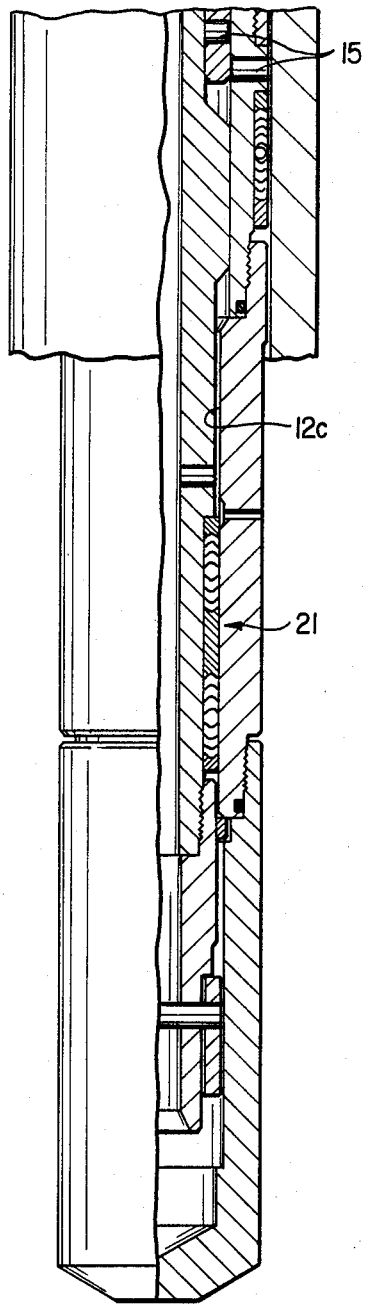
FIG. 7 is a fragmentary view of FIG. 1 showing the running tool disconnected from the installed plug.

After the plug is sealed and locked in the landing nipple, upward force on the running tool shears first pin 15 and moves the prong (via unsheared pin 17 ) and seals 21 upward in valve housing seal bore 12*c* (see FIG. 7).

Figure 8:
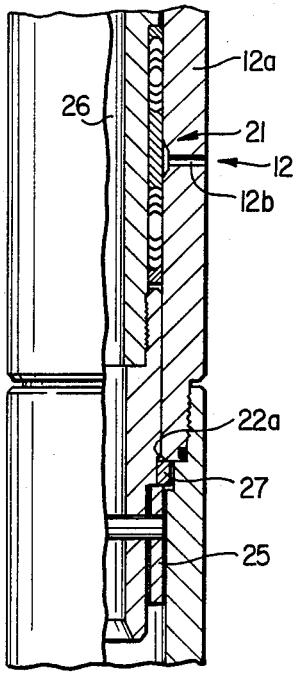
FIG. 8 is a fragmentary view of FIG. 1 showing the plug closed to flow.

FIG. 8 shows further upward movement of the running tool has moved seals 21 to above and below ports 12*b* in valve housing 12*a*, closing valve 12 and plug 10 to flow by preventing flow between the outside of the plug and flow passage 26. Ring 27 has moved inwardly under retainer upper shoulder 22*a*, locking the prong in up valve closed position. Upward movement of prong ring 25 is prevented when c-ring 27 contacts the lower end of the valve housing and prevents further upward movement of prong 16.

Figure 9:
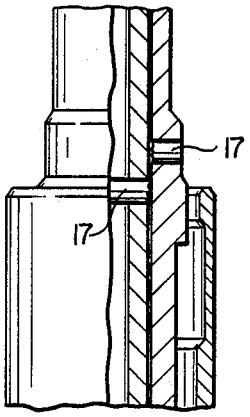
FIG. 9 is a fragmentary view of FIG. 1 showing the running tool disconnected from the prong.

Further upward force on the running tool shears pin 17 (see FIG. 9), releasing the runnign tool from the prong for removal from the well conduit.

Figure 10A:
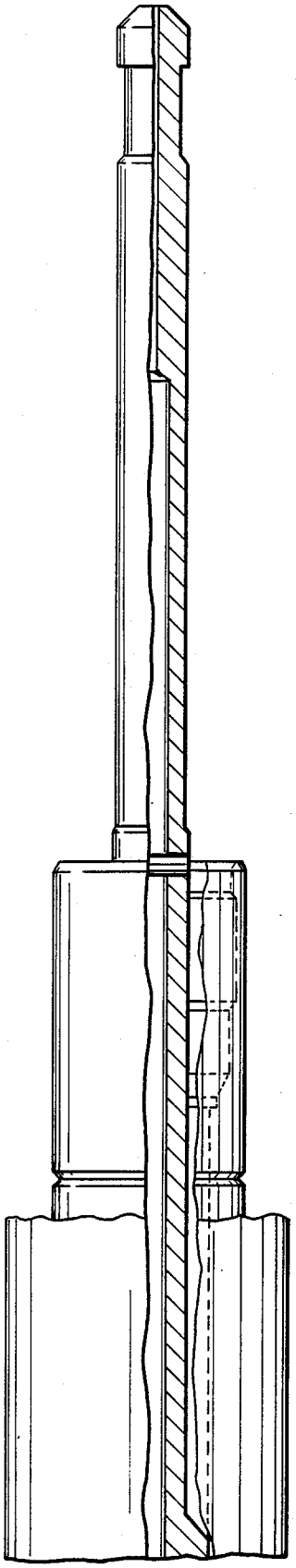
FIGS. 10A and 10B is a drawing in elevation and partial section showing the installed plug from which the running tool has been disconnected and raised to surface.
Figure 10B:
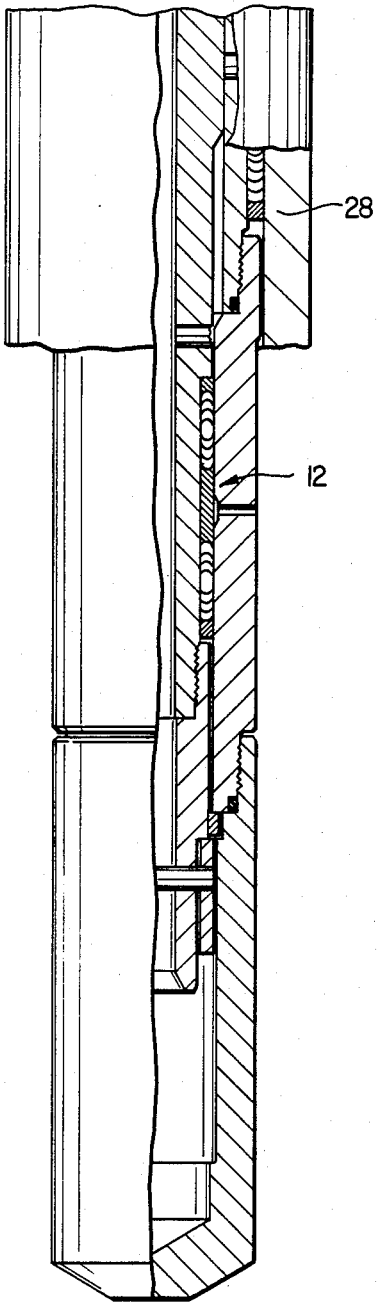

FIGS. 10A and 10B show the invention plug sealed and locked in the landing nipple. Valve 12 is closed and flow through the plug, landing nipple 28, and the well conduit is prevented.

Figure 11A:
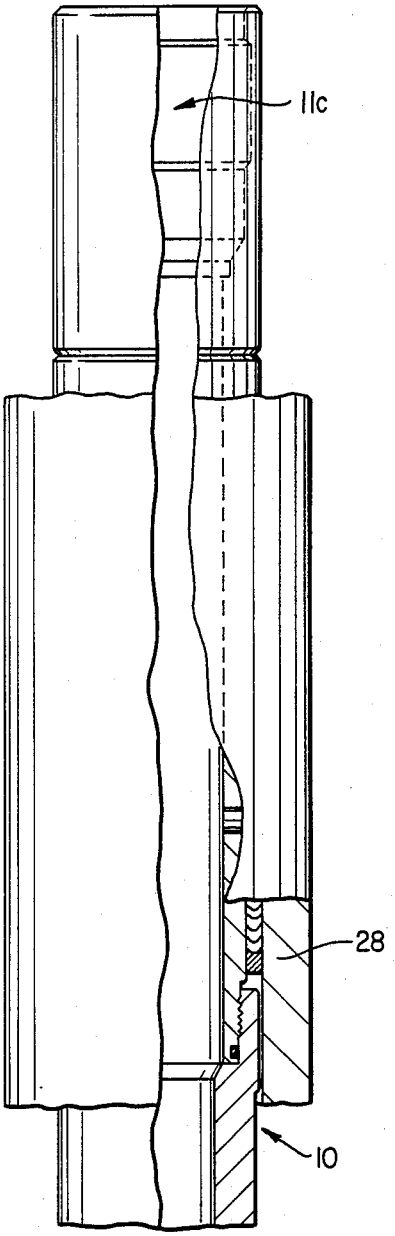
FIGS. 11A and 11B is also a drawing in elevation and partial section showing the installed plug after the prong has been disconnected and raised to surface.
Figure 11B:
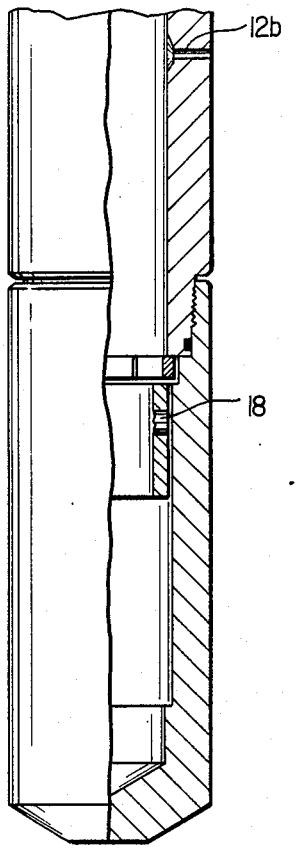

To remove the plug of this invention from the well conduit landing nipple, an appropriate pulling tool (not shown) is lowered to latch into pulling flange 23*a* on prong 16. Sufficient upward force is placed on the prong through the connected pulling tool to shear third shearable pin 18 disconnecting prong 16 from plug 10. As prong 16 and seals 21 are raised out of plug 10 for retrieval to surface, valve flow ports 12*b* are reopened to flow, as shown in FIGS. 11A and 11B and pressure inside and outside plug 10 will equalize. An appropriate pulling tool is now lowered to latch into lock mandrel fishing neck 11*c* for unlocking the lock mandrel from the landing nipple and retrieving plug 10 back to surface.

What is claimed is:

1. A plug for controlling flow through a lock mandrel comprising:

(a) a valve housing connectable to said lock mandrel and having flow ports therethrough;

(b) a cap connected on said valve housing;

(c) prong means in said valve housing, said prong means including an upper section having flow ports therethrough and seals thereon below said ports, said prong means longitudinally moveable from an open position permitting flow through said housing ports to a locked closed position preventing flow through said housing ports;

(d) means for locking said prong means in closed position including a retainer connected to said prong upper section below said seals, upper and lower shoulders on said retainer, and a c-ring around said retainer engageable with the lower end of said valve housing; and (e) means for releasably retaining said prong means in said valve housing.

2. The plug of claim 1 wherein the upper section has a fishing neck thereon.

3. The plug of claim 1 wherein the means for releasably retaining the prong means comprise:

(a) a ring around the retainer, below said lower retainer shoulder, said ring engageable with the lower end of the c-ring; and (b) a shearable pin releasably positioning said ring on said retainer.

4. A plug for controlling flow through a lock mandrel comprising:

(a) a valve housing connectable to said lock mandrel, said valve housing having ports for flow therethrough;

(b) a cap connected on said valve housing; and (c) prong means mounted in said plug for longitudinal movement between open position permitting flow through said ports and locked closed positions preventing flow through said plug, said prong means including: an upper section having flow ports therethrough, seals thereon below said upper section flow ports, a retainer having upper and lower shoulders thereon, said retainer connected on said prong upper section below said seals; and (d) means for locking said prong means in locked closed position including: a c-ring around said retainer, said c-ring positioned in said cap and engageable with the lower end of said valve housing.

5. A system for plugging a conduit comprising:

(a) a landing nipple in the conduit;

(b) plug means for sealingly engaging and locking in said landing nipple, said plug means including a locking mandrel, valve means in said plug for controlling flow through said plug, a cap connected to said valve means, prong means in said plug, said prong means longitudinally moveable from an open position, permitting flow through said valve means, to a locked closed position closing said valve means to flow, locking means in said plug for locking said prong means in closed position, and means releasably connecting said prong means in said plug; and (c) a running tool for sealingly engaging and locking said plug lock mandrel and plug means in said landing nipple and moving said prong means to said locked closed position, said running tool releasably connected to said lock mandrel by a first shearable pin, and said prong means releasably connected to said running tool by a second shearable pin.

6. The system of claim 5 wherein the first shearable pin requires less force to shear than the second shearable pin.

7. The system of claim 5 wherein the landing nipple has recesses and a seal bore therein.

8. The system of claim 7 wherein the lock mandrel includes keys and has seals thereon, said seals sealingly engageable in the landing nipple seal bore and said keys lockable in the landing nipple recesses.

9. The system of claim 5 wherein the prong means comprise:

(a) an upper section having flow ports therethrough; and (b) seal means on said upper section below said flow ports.

10. The system of claim 9 wherein the valve means comprise:

(a) a valve housing connected to the lower end of the lock mandrel, said housing having flow ports therethrough and a seal bore therein above and below said flow ports; and (b) the upper prong section seal means sealingly and slidably mounted for longitudinal movement in said valve housing seal bore.

11. The system of claim 9 wherein the locking means in the plug comprise:

(a) a retainer connected to the prong upper section below the seals;

(b) upper and lower shoulders on said retainer; and (c) a c-ring around said retainer, said c-ring positioned in a bore in the cap and engageable with the lower end of the valve housing.

12. The system of claim 11 wherein the means releasably connecting the prong in the plug comprise:

(a) a ring around the retainer below said lower retainer shoulder, said ring engageable with the lower end of the c-ring; and (b) a third shearable pin releasably positioning said ring on said retainer.

13. The system of claim 12 wherein the first shearable pin requires less force to shear than the second shearable pin and the second shearable pin requires less force to shear than the third shearable pin .

14. A system for plugging a conduit comprising:

(a) a landing nipple in the conduit, said landing nipple having recesses and a seal bore therein;

(b) plug means for sealing and locking in said landing nipple, said plug means including a lock mandrel having seals thereon and locking keys, said seals sealingly engageable in said landing nipple seal bore and said locking keys lockable in said landing nipple recesses, valve means in said plug for controlling flow through said plug, said valve means including a valve housing connected to the lower end of said lock mandrel, said housing having flow ports therethrough and a seal bore therein above and below said flow ports, a cap connected to the lower end of said valve housing, prong means including an upper section having flow ports therethrough and seals on said upper section below said flow ports, said upper section seals sealingly and slidably mounted for longitudinal movement in said valve housing seal bore, said prong means longitudinally moveable from an open position, permitting flow between the outside of said valve housing and the inside of said upper section, to a locked closed position preventing flow between the outside of said valve housing and the inside of said upper section, locking means in said plug for locking said prong means in closed position including a retainer connected to said prong upper section below said prong upper section seals, upper and lower shoulders on said retainer, and a c-ring around said retainer, said c-ring positioned in a bore in said cap and engageable with the lower end of said valve housing, and means releasably connecting said prong means in said valve housing and plug means including a ring around said retainer below said lower retainer shoulder, said ring engageable with the lower end of said c-ring, and a third shearable pin releasably positioning said ring on said retainer; and (c) a running tool for sealingly engaging and locking said plug means in said landing nipple and moving said prong means to said locked closed position, said running tool releasably connected to said lock mandrel by a first shearable pin, and said prong upper section releasably connected to said running tool by a second shearable pin.

15. The system of claim 14 wherein the first shearable pin requires less force to shear than the second shearable pin and the second shearable pin requires less force to shear than the third shearable pin.

* * * * *